US008851910B2

(12) United States Patent
Kobayashi

(10) Patent No.: US 8,851,910 B2
(45) Date of Patent: Oct. 7, 2014

(54) CONNECTOR

(71) Applicant: YAZAKI Corporation, Tokyo (JP)

(72) Inventor: Naoki Kobayashi, Aichi (JP)

(73) Assignee: Yazaki Corporation, Tokyo (JP)

( * ) Notice: Subject to any disclaimer, the term of this patent is extended or adjusted under 35 U.S.C. 154(b) by 28 days.

(21) Appl. No.: 13/857,709

(22) Filed: Apr. 5, 2013

(65) Prior Publication Data

US 2013/0224985 A1 Aug. 29, 2013

Related U.S. Application Data

(63) Continuation of application No. PCT/JP2011/073135, filed on Oct. 6, 2011.

(30) Foreign Application Priority Data

Oct. 7, 2010 (JP) ..... 2010-227478

(51) Int. Cl.

| | |
|---|---|
| ***H01R 13/62*** | (2006.01) |
| ***H01R 13/74*** | (2006.01) |
| ***H01R 13/629*** | (2006.01) |
| *H01R 13/631* | (2006.01) |

(52) U.S. Cl.

CPC ..... *H01R 13/62977* (2013.01); *H01R 13/74* (2013.01); *H01R 13/62933* (2013.01); *H01R 13/6315* (2013.01)

USPC ..... 439/157

(58) Field of Classification Search

USPC ..... 439/157, 372

See application file for complete search history.

(56) References Cited

U.S. PATENT DOCUMENTS

| | | | | |
|---|---|---|---|---|
| 5,975,929 | A * | 11/1999 | Matsuura et al. | 439/157 |
| 2001/0046797 | A1 | 11/2001 | Sasaki et al. | |
| 2001/0053623 | A1 | 12/2001 | Fukamachi | |
| 2007/0173089 | A1* | 7/2007 | Murakami et al. | 439/157 |
| 2007/0207647 | A1* | 9/2007 | Imai et al. | 439/157 |

FOREIGN PATENT DOCUMENTS

| | | | |
|---|---|---|---|
| JP | 11-26079 | A | 1/1999 |
| JP | 2001-176604 | A | 6/2001 |
| JP | 2001-250634 | A | 9/2001 |
| JP | 2001-351743 | A | 12/2001 |
| JP | 2002-56939 | A | 2/2002 |
| JP | 2002-110300 | A | 4/2002 |

OTHER PUBLICATIONS

Office Action from co-pending Korean Patent App. No. 10-2013-7008847 dated May 20, 2014 with English language translation thereof.

International Search Report for PCT/JP2011/073135 and Form PCT/ISA/237 dated Nov. 22, 2011.

* cited by examiner

*Primary Examiner* — Phuong Dinh

(74) *Attorney, Agent, or Firm* — Kenealy Vaidya LLP

(57) ABSTRACT

A receiving housing is displaceable in the direction to be pushed out from the opening of a bottom panel by a connecting operation. One end of a lever can be engaged with a counterpart housing and the other end can be engaged with a rotating shaft protrusion of the bottom panel. The counterpart housing is pulled towards the receiving housing by means of the lever that pivots around a portion to be engaged with the rotating shaft protrusion of the bottom panel as a fulcrum by the displacement of the receiving housing in cooperation with the connecting operation.

2 Claims, 11 Drawing Sheets

CONNECTOR

BACKGROUND

The present invention is related to a connector.

In recent years, a connector which can be easily inserted and removed by a lever mechanism is utilized (see Patent Documents 1 to 4).

According to this kind of connector, as illustrated in FIG. 16, as a slide member 3 is moved with respect to a female connector 1, an insertion force is reduced by a rotation of a lever 4 pivotally supported by a male connector 6 in a state in which the lever 4 is engaged with a tongue 5*a* of an engaged portion 5 which is provided on the male connector 6.

However, the female connector 1 includes the lever 4 which is rotatably provided to pull the male connector 6, and the slide member 3 which is slidably provided to rotate the lever 4. For this reason, the number of components is increased, and thus the structure is complicated, thereby causing its cost to increase.

Further, to pivot the lever 4, in addition to the operation of fitting the female connector 1 and the male connector 6, an operation of sliding the slide member 3 is necessary. For this reason, the lever-type connector is required for the improvement in workability.

[Patent Document 1] JP-A-2001-176604
[Patent Document 2] JP-A-2001-250634
[Patent Document 3] JP-A-2002-56939
[Patent Document 4] JP-A-2001-351743

SUMMARY

It is therefore one advantageous aspect of the present invention to provide a connector which can be inserted and removed with a small force and a simple operation, without causing the increase in cost.

According to one advantage of the invention, there is provided a connector comprising:

a receiving housing configured to be inserted and mounted in an opening of a panel;

a counterpart housing configured to be connected to the receiving housing; and a lever pivotally provided on the receiving housing and configured to pivot in accordance with a connecting operation of the counterpart housing to pull the counterpart housing, wherein the receiving housing is displaceable in a direction to be pushed out from the opening of the panel by the connecting operation, the lever includes one end to be engaged with the counterpart housing and the other end to be engaged with the panel, and the counterpart housing is pulled toward the receiving housing by the lever which pivots around a portion engaged with the panel as a fulcrum by the displacement of the receiving housing in accordance with the connecting operation.

The connector may be configured such that: the counterpart housing is mounted on an end face panel forming an end face of a case, and the receiving housing is mounted on a bottom panel forming a bottom of a box in which the case is fitted, and the bottom is opposite to the end face panel.

BRIEF DESCRIPTION OF DRAWINGS

FIGS. 6A to 6C are views illustrating the connector prior to connection, in which FIG. 6A is a cross-sectional view taken along the line (a)-(a) in FIG. 5, FIG. 6B is a cross-sectional view taken along the line (b)-(b) in FIG. 5, and FIG. 6C is a cross-sectional view taken along the line (c)-(c) in FIG. 5.

FIGS. 13A to 13C are views illustrating the connector when a connecting operation starts, in which FIG. 13A is a cross-sectional view taken along the line (a)-(a) in FIG. 5, FIG. 13B is a cross-sectional view taken along the line (b)-(b) in FIG. 5, and FIG. 13C is a cross-sectional view taken along the line (c)-(c) in FIG. 5.

FIGS. 14A to 14C are views illustrating the connector on the way of the connecting operation, in which FIG. 14A is a cross-sectional view taken along the line (a)-(a) in FIG. 5, FIG. 14B is a cross-sectional view taken along the line (b)-(b) in FIG. 5, and FIG. 14C is a cross-sectional view taken along the line (c)-(c) in FIG. 5.

FIGS. 15A to 15C are views illustrating the connector when the connecting operation is completed, in which FIG. 15A is a cross-sectional view taken along the line (a)-(a) in FIG. 5, FIG. 15B is a cross-sectional view taken along the line (b)-(b) in FIG. 5, and FIG. 15C is a cross-sectional view taken along the line (c)-(c) in FIG. 5.

DETAILED DESCRIPTION OF EXEMPLIFIED EMBODIMENTS

An embodiment of the present invention will now be described with reference to the accompanying drawings.

Figure 1:
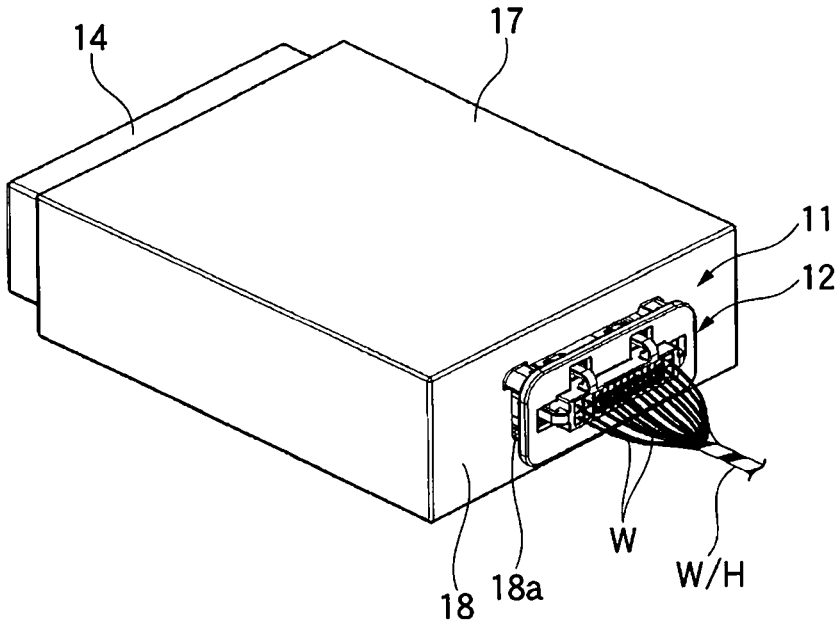
FIG. 1 is a perspective view illustrating an ECU employing a connector according to one embodiment of the present invention.
Figure 2:
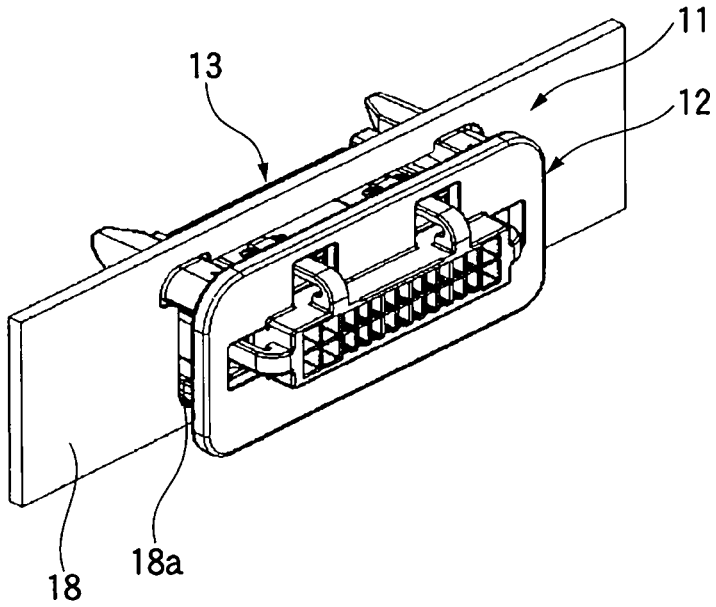
FIG. 2 is a perspective view illustrating the connector according to the embodiment of the present invention.
Figure 3:
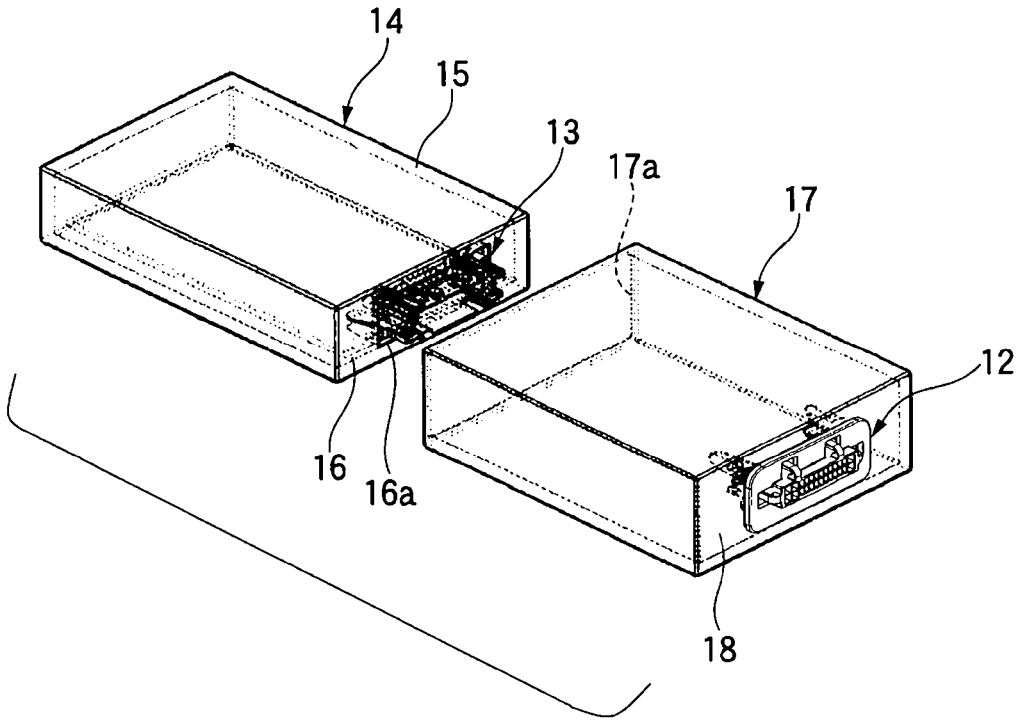
FIG. 3 is a perspective view illustrating a state in which the ECU employing the connector according to the embodiment of the present invention is separated from an ECU box.
Figure 4:
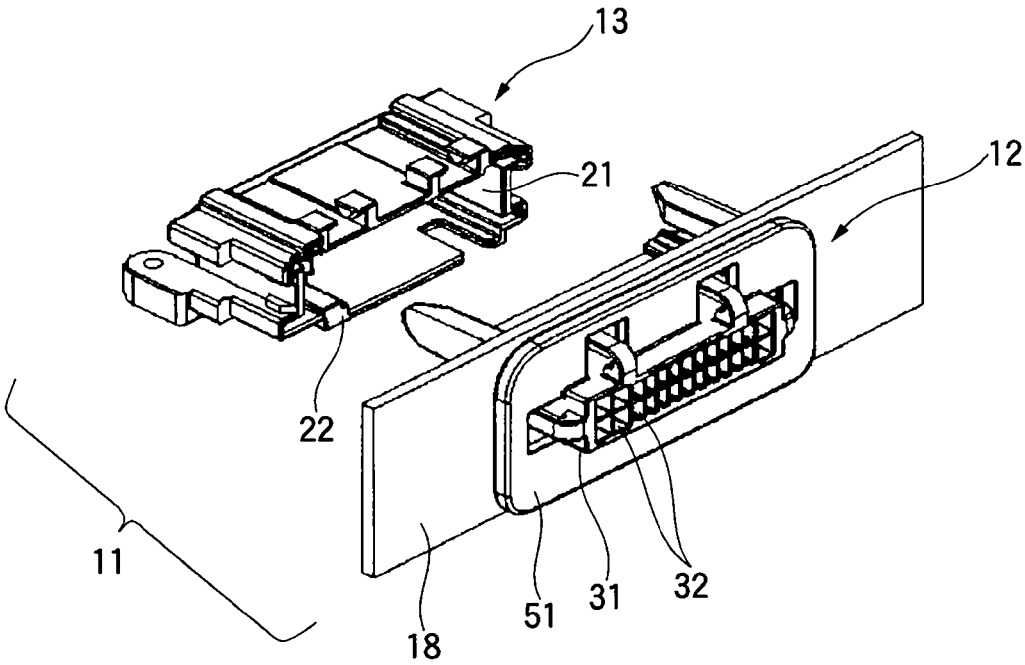
FIG. 4 is a perspective view illustrating a state in which a receiving housing of the connector according to the embodiment of the present invention is separated from a counterpart housing.

FIG. 1 is a perspective view illustrating an ECU employing a connector according to one embodiment of the present invention. FIG. 2 is a perspective view illustrating the connector according to the embodiment of the present invention. FIG. 3 is a perspective view illustrating a state in which the ECU employing the connector according to the embodiment of the present invention is separated from an ECU box. FIG. 4 is a perspective view illustrating a state in which a receiving housing of the connector according to the embodiment of the present invention is separated from a counterpart housing;

As illustrated in FIGS. 1 to 4, a connector 11 according to this embodiment includes a receiving housing 12 and a counterpart housing 13 connected to the receiving housing 12.

The counterpart housing 13 is provided on an end face panel 16 formed by an end face of a case 15 of an ECU (electronic control unit) 14 which is mounted on a vehicle such as an automobile. A circuit board (not illustrated) is accommodated in the ECU 14, and a plurality of terminals connected to the circuit board are received in the housing 13.

The receiving housing 12 is provided on a bottom panel 18 formed by a bottom of an ECU box 17 which is mounted on the ECU 14, and a wire harness W/H bundled with a plurality of electric wires W is connected to the receiving housing 12. The ECU box 17 has an opening 17*a* at a side opposite to the bottom panel 18, and the ECU 14 is fitted through the opening 17*a*. As the ECU 14 is fitted in the ECU box 17 via the opening 17*a*, the counterpart housing 13 is connected to the receiving housing 12 of the ECU box 17, and the electric wires W of the wire harness W/H are electrically connected with the circuit board in the ECU 14 via the connector 11.

Figure 5:
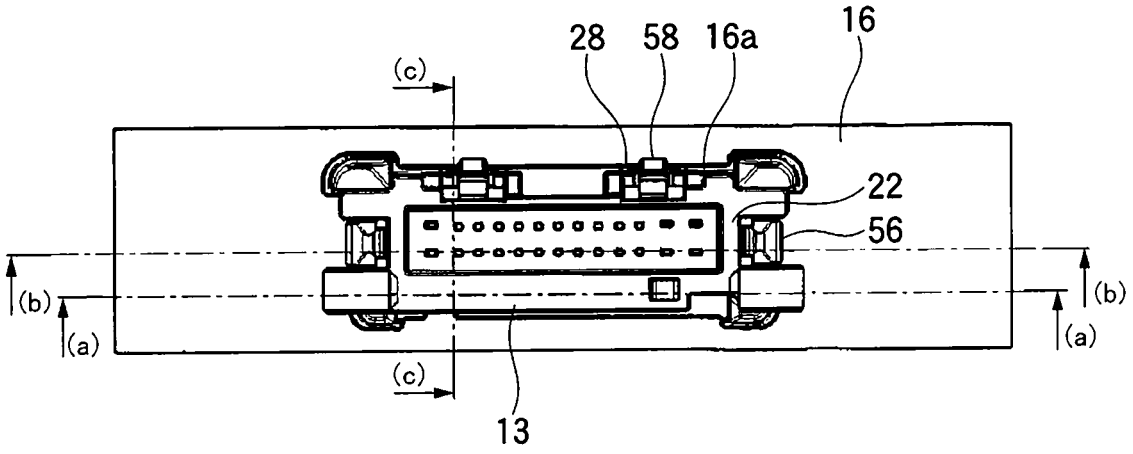
FIG. 5 is a rear view of the connector when seen from an inside of a case of the ECU.

The counterpart housing 13 is formed by a synthetic resin. As illustrated in FIGS. 5 to 7, the counterpart housing 13 is provided with a hood part 22 having a fitting hole 21 at a side to be connected with the receiving housing 12. The counterpart housing 13 is provided with a plurality of cavities 23 of two upper and lower rows arranged in a width direction at a side opposite to the connection side of the receiving housing 12, and a male terminal 24 connected to the circuit board in ECU 14 is accommodated in the cavity 23 (see FIG. 6B).

Further, the counterpart housing 13 is provided with a lever accommodating concave 25 at a bottom side in the hood part 22, and a lever 41 which will be described later is received in the lever accommodating concave 25. The lever accommodating concave 25 is provided with a lever engaging step 26 and a lever pressing curved portion 27 in one side thereof.

An upper portion of the counterpart housing 13 is provided with releasing portions 28 near both sides thereof at the opening side of the fixing hole 21. The releasing portion 28 has a pair of releasing pieces 29 protruding toward an upper side, and front ends of these releasing pieces 29 are provided with release claws 29*a* protruding in a direction opposite to each other.

The counterpart housing 13 is fitted in an opening 16*a*, which is formed in the end face panel 16 forming the case 15 of the ECU 14, from the inside of the ECU 14. Thus, the counterpart housing 13 protrudes through the opening 16*a* of the end face panel 16 of the ECU 14.

The receiving housing 12 is formed by a synthetic resin. As illustrated in FIGS. 6A to 6C and FIGS. 8 to 10, the receiving housing 12 includes a terminal accommodating housing 31 which is formed in a box shape. The terminal accommodating housing 31 is provided with a plurality of cavities 32 of two upper and lower rows arranged in the width direction, and these cavities 32 are accommodated with female terminals 33 connected with the electric wires W of the wire harness W/H (see FIG. 6B).

The terminal accommodating housing 31 is fitted in the counterpart housing 13 via the fitting hole 21, so that the male terminal 24 of the counterpart housing 13 is electrically connected with the female terminal 33 of the receiving housing 12. Meanwhile, the female terminal 33 is inserted from the side opposite to a connection end 31*a* of the counterpart housing 13, and then is accommodated in the cavity 32.

The terminal accommodating housing 31 is provided with a hole 35 at a bottom side thereof. The hole 35 is formed to extend across an intermediate portion of the cavity 32, and the female terminals 33 are disposed at the connection end 31*a* rather than the hole 35. A locking spacer 36 is inserted into the hole 35, and a rear end side of the female terminal 33 in an insertion direction accommodated in each cavity 32 is locked by the locking spacer 36.

The receiving housing 12 is provided with the plate-shaped lever 41 at the bottom side of the terminal accommodating housing 31. The lever 41 is provided with an elongated slot 42 at its intermediate portion, and a lever support boss 37 protruding from the bottom of the terminal accommodating housing 31 is inserted into the elongated slot 42. In this way, the lever 41 is able to pivot around the lever support boss 37. Further, the lever support boss 37 is movable in a longitudinal direction within a range in which the lever support boss 37 abuts against both ends of the elongated slot 42.

The lever 41 is provided with a pulling claw portion 43 protruding from one end of the lever 41. The pulling claw portion 43 has a curved surface 43*a* bulging out toward the connection end 31*a*. The other end of the lever 41 is provided with an engaging concave portion 44, and the engaging concave portion 44 is configured to engage with a rotating shaft protrusion 19 formed on the bottom panel 18 of the ECU box 17.

The receiving housing 12 has a planar plate portion 51. The plate portion 51 is provided near a side opposite to the connection end 31*a* in the terminal accommodating housing 31. The plate portion 51 is provided with guide protrudes 52 at four corners at a side of the connection end 31*a*. Further, the plate portion 51 is provided with holes 53 and 54 each near both sides of the terminal accommodating housing 31 and both sides of an upper side of the terminal accommodating housing 31.

The receiving housing 12 has fitting support locking pieces 56 at both sides of the terminal accommodating housing 31. The fitting support locking piece 56 is connected to the end opposite to the connection end 31*a* of the terminal accommodating housing 31 to extend toward the connection end 31*a*. The fitting support locking piece 56 is inserted into the hole 53 formed in the plate portion 51, and reaches the connection end 31*a* rather than the plate portion 51. The fitting support locking piece 56 is provided with an engaging claw portion 56*a* protruding from a front end thereof toward the outside.

The receiving housing 12 has panel temporarily fixing pieces 58 near both sides of the upper portion of the terminal accommodating housing 31. The panel temporarily fixing piece 58 is also connected to the end opposite to the connection end 31*a* of the terminal accommodating housing 31 to extend toward the connection end 31*a*. The panel temporarily fixing piece 58 is inserted into the hole 53 formed in the plate portion 51, and reaches the connection end 31*a* rather than the plate portion 51. The panel temporarily fixing piece 58 is provided with a temporarily engaging claw portion 58*a* protruding toward the outside. The panel temporarily fixing piece 58 is provided with a release protrusion 58*b* protruding from a front end thereof toward both sides.

A dimension of the engaging claw portion 56*a* of the fitting support locking piece 56 from the plate portion 51 is larger than that of the temporarily engaging claw portion 58*a* of the panel temporarily fixing piece 58 from the plate portion 51. Further, a dimension of the temporarily engaging claw portion 58*a* of the panel temporarily fixing piece 58 from the plate portion 51 is substantially equal to a plate thickness of the bottom panel 18 of the ECU box 17.

The receiving housing 12 is fitted and mounted in a opening 18*a* formed in the bottom panel 18 from the outside which is the side opposite to the opening 17*a* of the ECU box 17.

Figure 11:
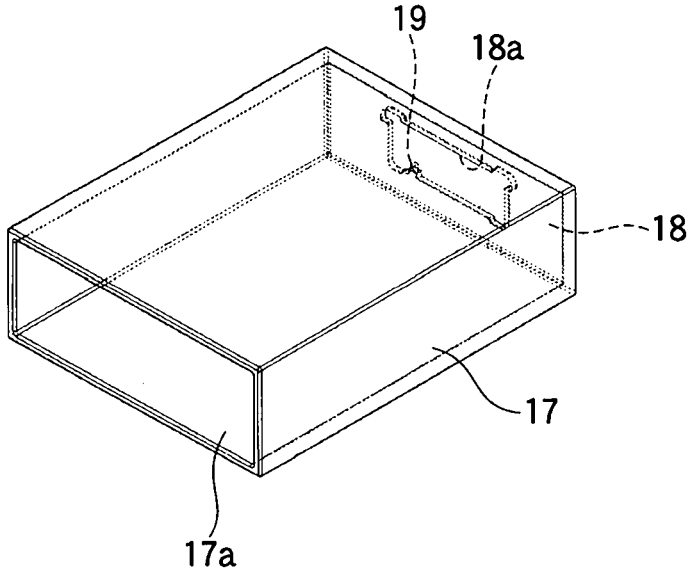
FIG. 11 is a perspective view schematically illustrating the ECU box on which the receiving housing is mounted.
Figure 12:
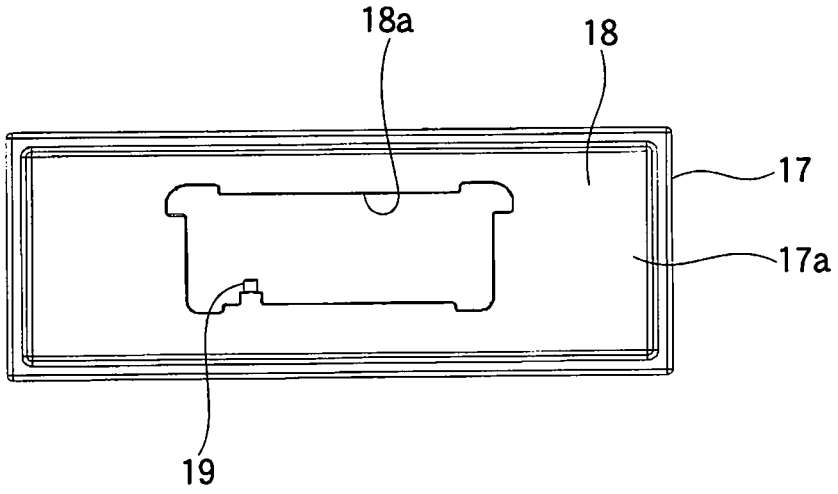
FIG. 12 is a front view of a bottom panel of the ECU box on which the receiving housing is mounted.

The receiving housing 12 is provided with the opening 18*a* at the bottom panel 18, as illustrated in FIGS. 11 and 12, and the connection end 31*a* rather than the plate portion 51 of the receiving housing 12 is inserted into the opening 18*a*. The opening 18*a* is formed to have a shape smaller than that of the plate portion 51, and thus the plate portion 51 abuts against the bottom panel 18 by inserting and mounting the receiving housing 12 into the opening 18*a* from the outside of the ECU box 17, thereby restraining further insertion.

Further, the rotating shaft protrusion 19 protrudes upwardly from a lower edge of the opening 18*a* formed in the bottom panel 18. The rotating shaft protrusion 19 is provided at the engaging concave portion 44 of the lever 41 of the receiving housing 12 which is inserted into the opening 18*a*. In this way, if the receiving housing 12 is mounted in the opening 18*a*, the rotating shaft protrusion 19 is engaged with the engaging concave portion 44 of the lever 19.

The case where the receiving housing 12 is connected to the counterpart housing 13 to configure the connector 11 will now be described with reference to FIGS. 13A to 15C.

Figure 13A:
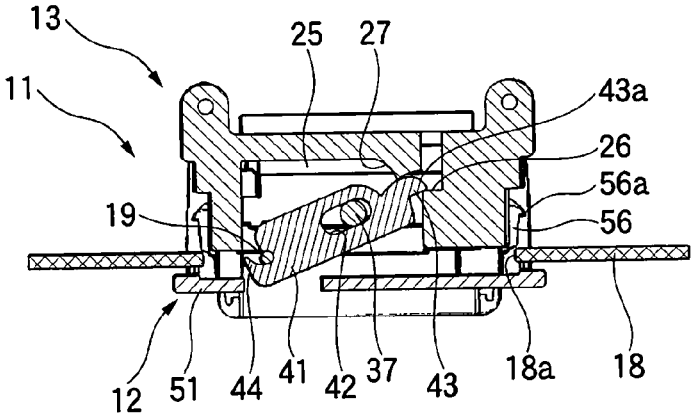
Figure 13B:
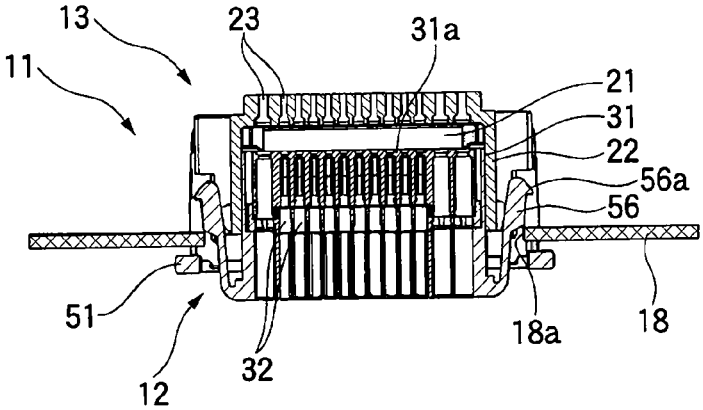
Figure 13C:
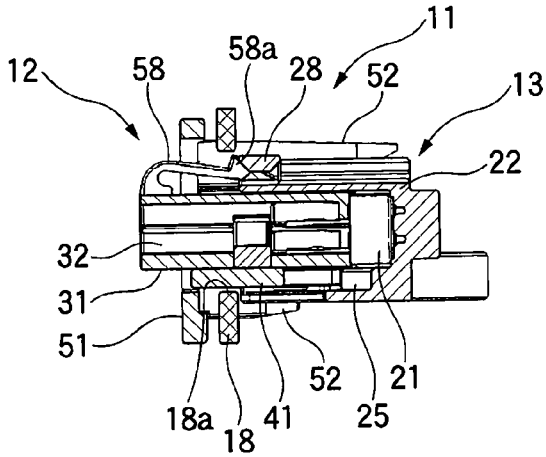
Figure 14A:
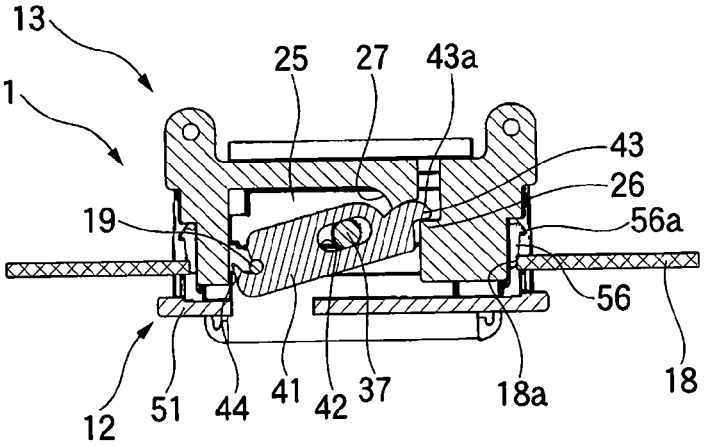
Figure 14B:
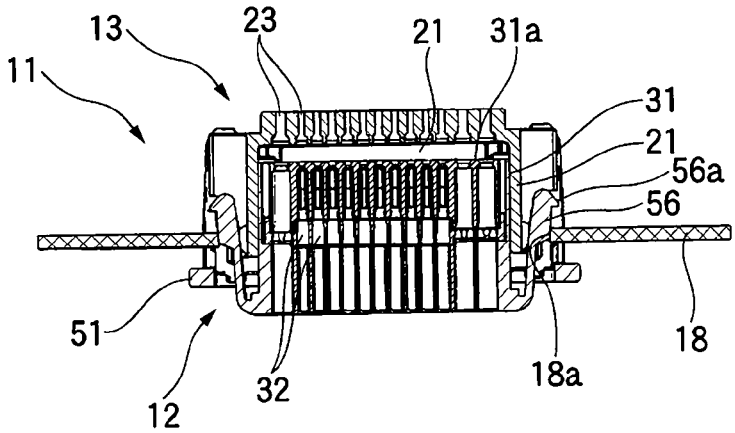
Figure 14C:
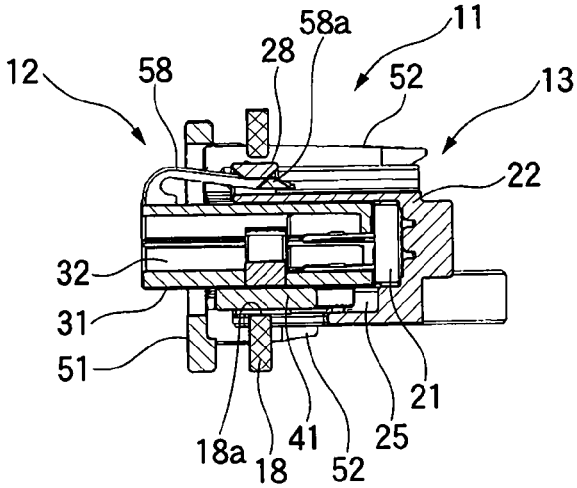
Figure 15A:
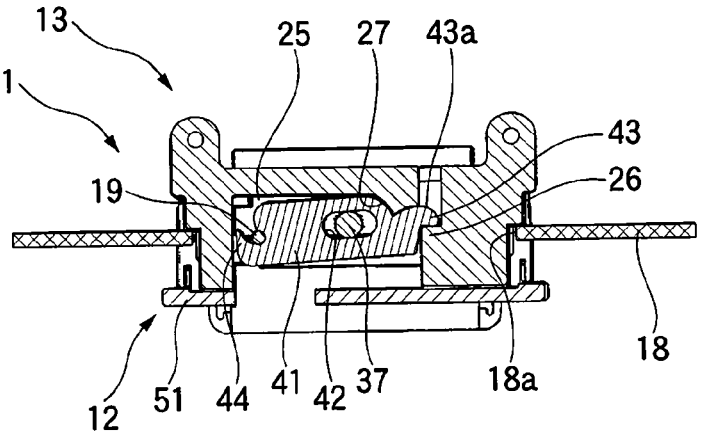
Figure 15B:
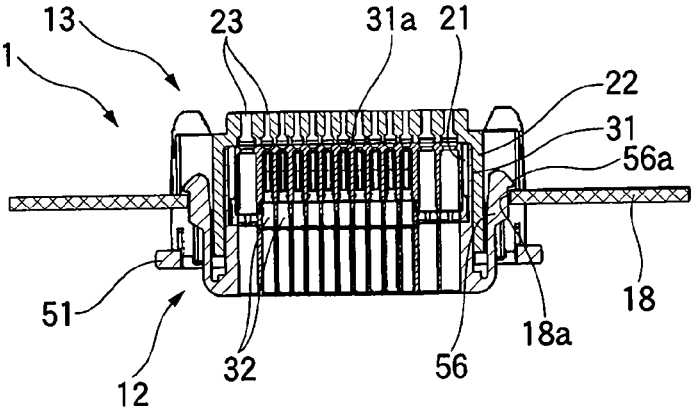
Figure 15C:
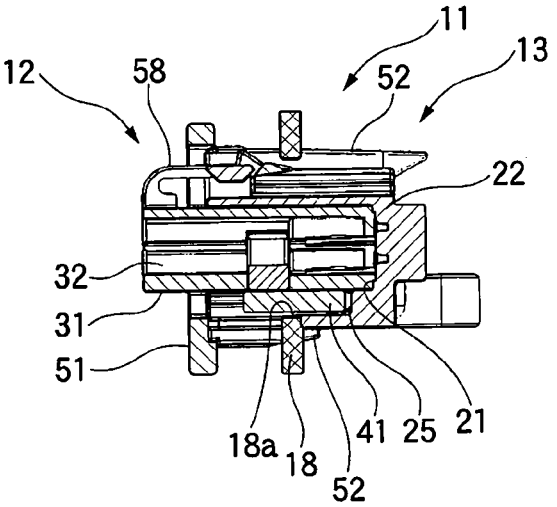
Figure 16:
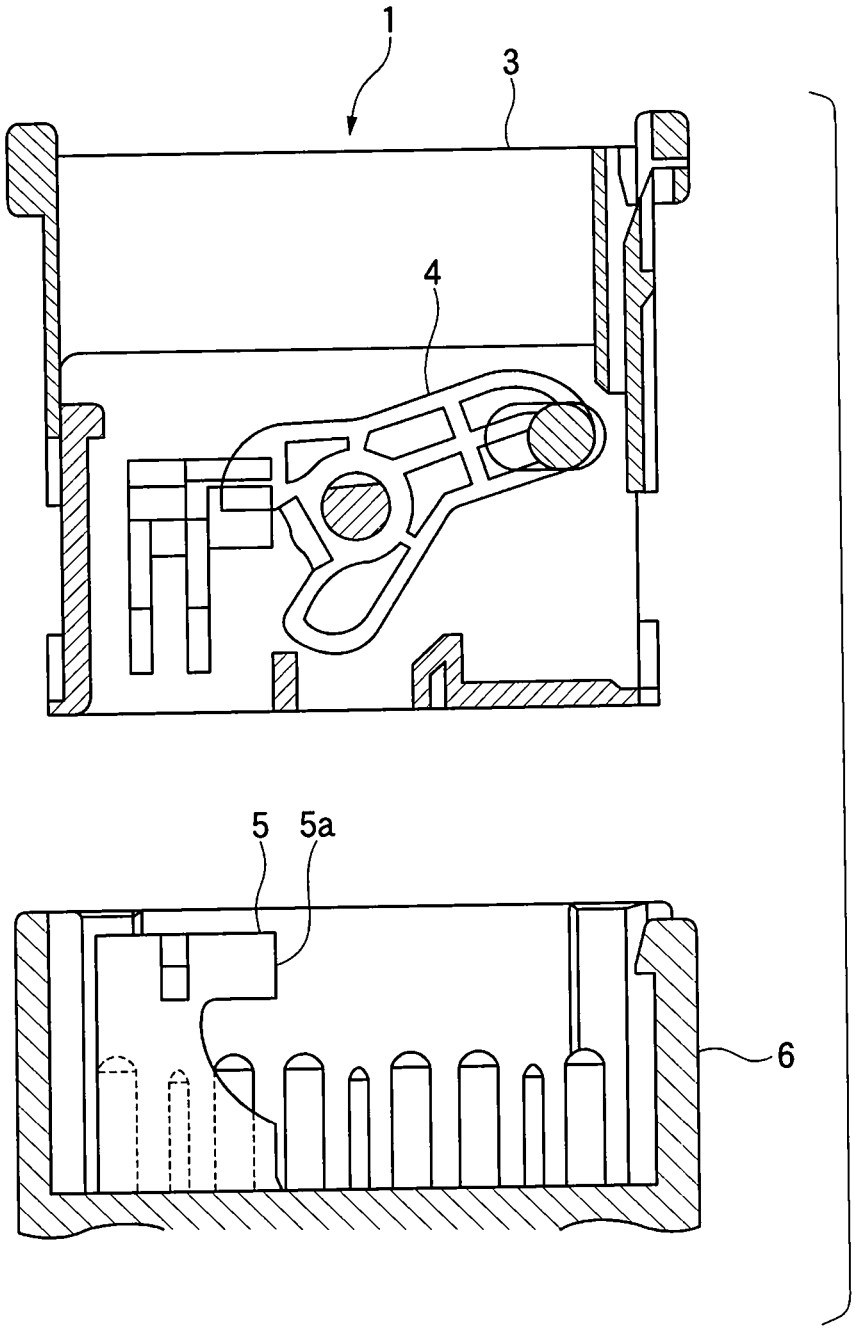
FIG. 16 is a cross-section view illustrating a connector according to the related art.

FIGS. 13A to 13C are views illustrating the connector when a connecting operation starts. FIGS. 14A to 14C are views illustrating the connector on the way of the connecting operation. FIGS. 15A to 15C are views illustrating the connector when the connecting operation is completed.

First, the receiving housing 12 is mounted in the ECU box 17 as preliminary preparation. Specifically, the female terminals 33 connected to the electric wires W of the wire harness W/H are respectively accommodated in the cavities 32 of the terminal accommodating housing 31 of the receiving housing 12, and the locking spacer 36 is inserted into the hole 35, thereby preventing the female terminal 33 from being released. Further, the lever 41 is attached to the bottom side of the receiving housing 12. The receiving housing 12 is inserted into the opening 18*a* of the bottom panel 18 of the ECU box 17 until the plate portion 51 abuts against the bottom panel 18. In this way, the temporarily engaging claw portion 58*a* of the panel temporarily fixing piece 58 is engaged with the edge of the opening 18*a* of the bottom panel 18, and the receiving housing 12 is temporarily fixed to the bottom panel 18, which becomes a standby state to wait for the counterpart housing 13 (see FIGS. 6A to 6C).

Figure 6A:
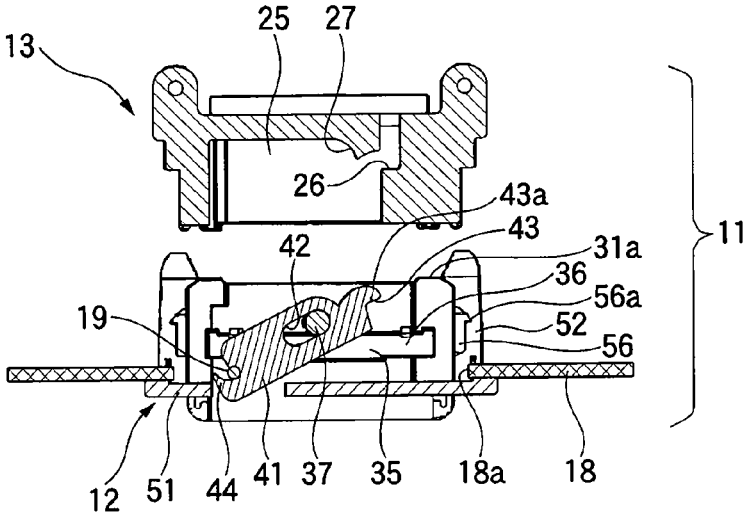
Figure 6B:
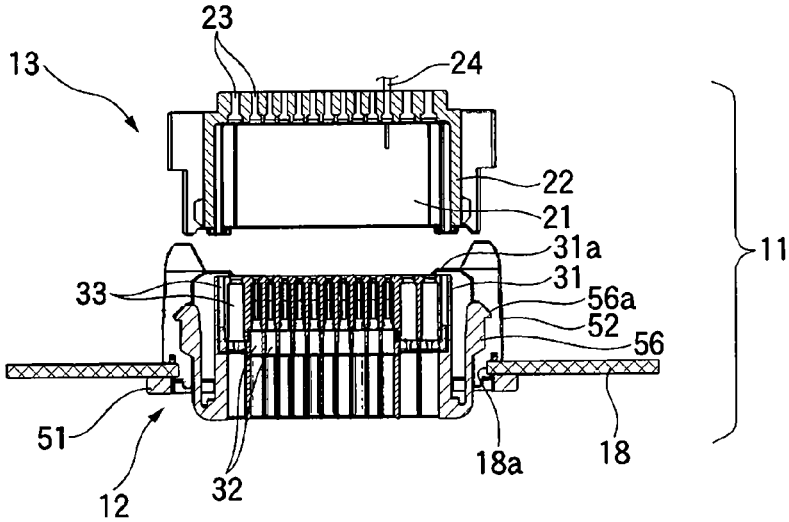
Figure 6C:
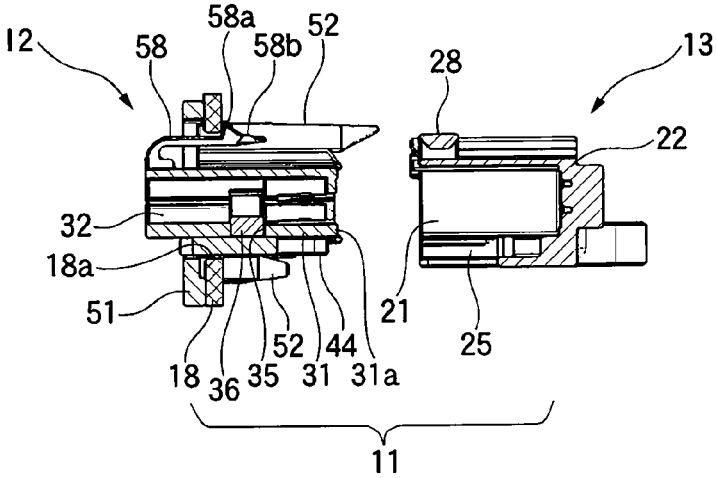
Figure 7:
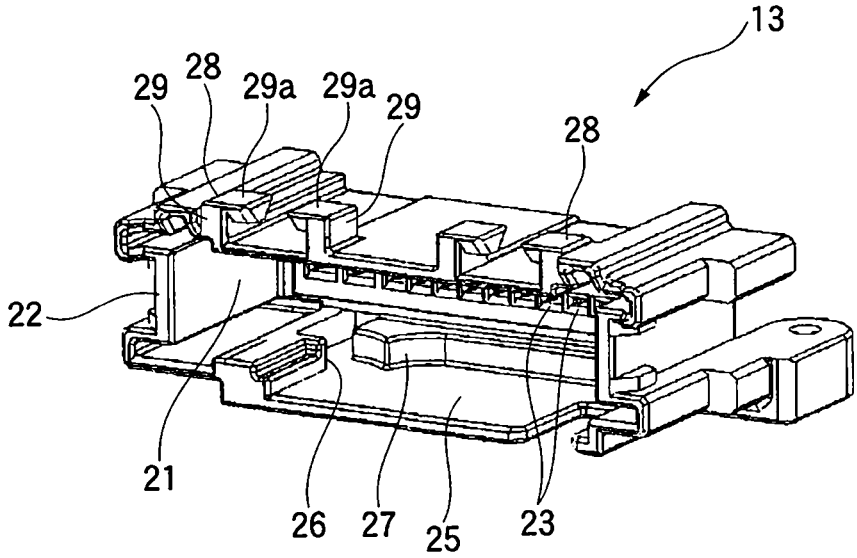
FIG. 7 is a perspective view of the counterpart housing.
Figure 8:
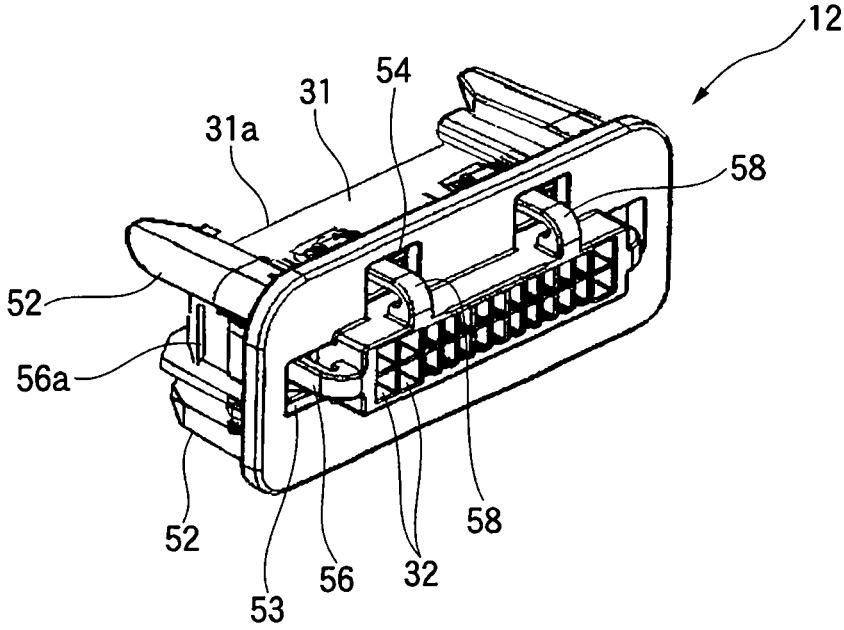
FIG. 8 is a perspective view of the receiving housing.
Figure 9:
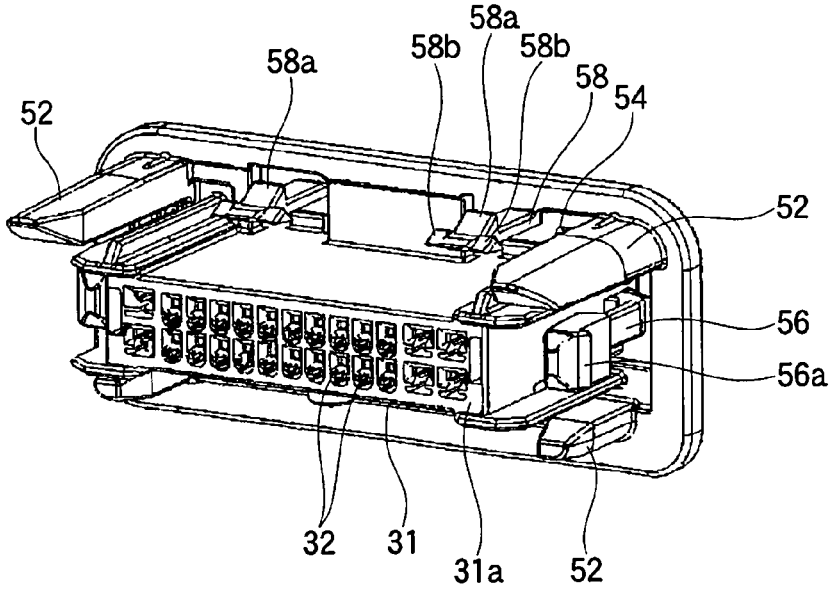
FIG. 9 is a perspective view of the receiving housing when seen from a connection terminal side thereof.
Figure 10:
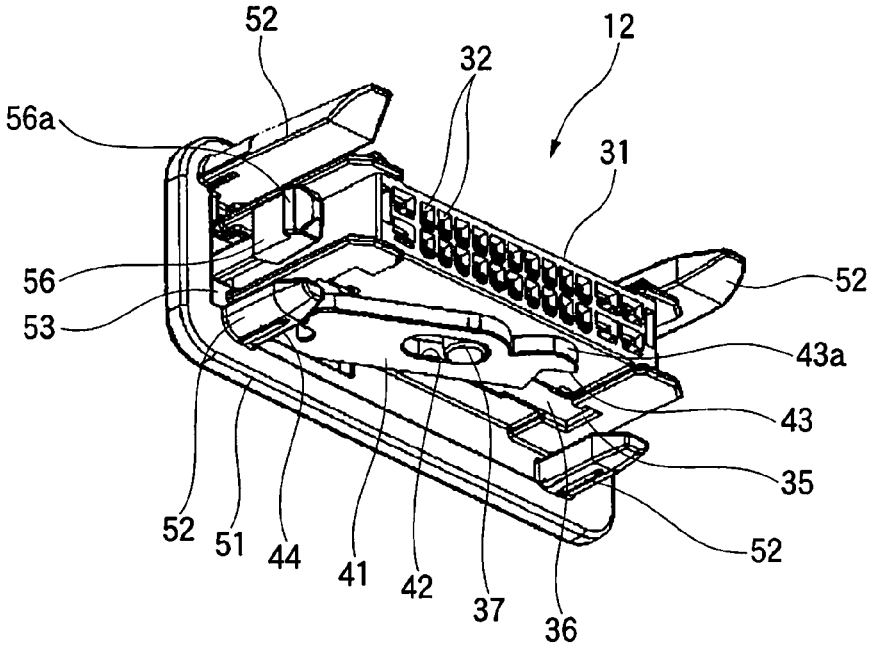
FIG. 10 is a perspective view of the connection terminal side of the receiving housing when seen from a lower side thereof.

In the standby state, the engaging concave portion 44 of the lever is engaged with the rotating shaft protrusion 19 formed at the edge of the opening 18*a* (see FIG. 6A).

If the receiving housing 12 is temporarily mounted in the ECU box 17 to become the standby state, the ECU 14 is fitted in the opening 17*a* of the ECU box 17.

As illustrated in FIGS. 13A to 13C, the release claw 29*a* formed on the release piece 29 of the releasing portion 28 abuts against the release protrusion 58*b* of the front end of the panel temporarily fixing piece 58, and thus the panel temporarily fixing piece 58 is pushed, thereby releasing the engaging state of the bottom panel 18 with the temporarily engaging claw portion 58*a* of the panel temporarily fixing piece 58. The receiving housing 12 released from the engaging state with the panel temporarily fixing piece 58 is displaced in a pushing direction from the opening 18*a* of the bottom panel 18 by the counterpart housing 13. Further, the pulling claw portion 43 of the lever 41 is engaged with the lever engaging step 26 of the counterpart housing 13.

In this way, when the receiving housing 12 is pushed out from the opening 18*a* of the bottom panel 18, the intermediate portion of the lever 41 is pulled in a displacement direction of the receiving housing 18 by the lever support protrusion 37, and then the lever 41 pivots around the rotating shaft protrusion 19 of the bottom panel 18, with which the engaging concave portion 44 is engaged, as a fulcrum. As the lever 41 pivots, the counterpart housing 13 is pulled toward the receiving housing 12, and the terminal accommodating housing 31 of the receiving housing 12 enters the fitting hole 21 of the counterpart housing 13.

Further, the fitting support locking pieces 56 provided at both sides of the receiving housing 12 are outwardly pushed and enlarged by both sides of the hood part 22 of the counterpart housing 13, and then are compressed by the edges of both sides of the opening 18*a*.

As illustrated in FIGS. 14A to 14C, when the ECU 14 is further fitted in the opening 17*a* of the ECU box 17, the receiving housing 12 is further pushed out from the opening 18*a* of the bottom panel 18, and then is displaced, so that the lever 41 further pivots around the rotating shaft protrusion 19 of the bottom panel 18 as the fulcrum. In this way, the counterpart housing 13 is further pulled toward the receiving housing 12 by the lever 41, and the terminal accommodating housing 31 of the receiving housing 12 further enters the fitting hole 21 of the counterpart housing 13, thereby starting the connection of the female terminal 33 of the receiving housing 12 and the male terminal 24 of the counterpart housing 13.

As illustrated in FIGS. 15A to 15C, if the ECU 14 is completely fitted in the opening 17*a* of the ECU box 17, the receiving housing 12 is further pushed out from the opening 18*a* of the bottom panel 18, and thus the lever 41 further pivots around the rotating shaft protrusion 19 as the fulcrum. Thus, the counterpart housing 13 is further pulled toward the receiving housing 12 by the lever 41, and the terminal accommodating housing 31 of the receiving housing 12 further enters the fitting hole 21 of the counterpart housing 13, so that the connection of the female terminal 33 of the receiving housing 12 and the male terminal 24 of the counterpart housing 13 is completed. As a result, the electric wires W of the wire harness W/H are electrically connected with the wiring board in the ECU 14. Further, the engaging claw portions 56*a* of the fitting support locking pieces 56 which are outwardly pushed and enlarged are fitted in the edges of both sides of the opening 18*a*, so that the receiving housing 12 is fixed to the bottom panel 18.

To release the connection of the receiving housing 12 and the counterpart housing 13 which are connected to each other by the above process, the ECU 14 is pulled out from the ECU box 17 in reverse order of the connection.

In this way, the intermediate portion of the lever 41 is pulled in the counterpart housing 13 by the lever support protrusion 37, and the lever 41 pivots around the rotating shaft protrusion 19 as a fulcrum in a reverse direction of the connection.

As the lever 41 pivots in the reverse direction, the curved surface 43*a* of the lever 41 presses the lever pressing curved portion 27 of the counterpart housing 13. Thus, the counterpart housing 13 is separated from the receiving housing 12 by the pressing force of the lever 41, and the terminal accommodating housing 31 of the receiving housing 12 is pulled out from the fitting hole 21 of the counterpart housing 13, so that the female terminal 33 of the receiving housing 12 is disconnected from the male terminal 24 of the counterpart housing 13 to release the electrically connecting state between the electric wires W of the wire harness W/H and the wiring board in the ECU 14.

The plate portion of the receiving housing 12 pulled toward the counterpart housing 13 abuts against the bottom panel 18, and the temporarily engaging claw portion 58*a* of the panel temporarily fixing pieces 58, of which the release protrusion 58*b* is separated from the release piece 29 of the releasing portion 28, is engaged with the bottom panel 18. That is, since the receiving housing 12 is temporarily fixed to the bottom panel 18 of the ECU box 17 to become the standby state, the receiving housing is not released from the ECU box 17 even by releasing the connection with the counterpart housing 13.

With the connector according to this embodiment, as only the connecting operation is carried out, the counterpart housing 13 is pulled toward the receiving housing 12 by the built-in lever 41 which pivots around the portion engaged with the rotating shaft protrusion 19 of the bottom panel 18 by the displacement of the receiving housing 12, so that the receiving housing 12 and the counterpart housing 13 are easily connected to each other with a small force.

As compared with a structure including a slide member for pivoting the lever to pull the housings mutually, in which the slide member is slid to connect the housings, the number of the components can be reduced, and thus the construction can be simplified, thereby lowering its cost. Further, it can skip a complicated operation to slide the slide member.

If the connector 11 is utilized, the receiving housing 12 can be very easily connected to the counterpart housing 13 by fitting the case 15 of the ECU 14 to the ECU box 17. Further, accompanying the connecting operation, since the receiving housing 12 is displaced in the direction to be pulled out from the opening 18*a* of the bottom panel 18, a space between the end face panel 16 of the case 15 and the bottom panel 18 of the ECU box 17 can be reduced as much as possible. Thus, it is possible to downsize an electronic device constituted of the ECU 14 including the ECU box 17 and the case 15.

In the connector according to the invention, as only the connecting operation is carried out, the counterpart housing is pulled toward the receiving housing by the lever which pivots around the portion engaged with the panel by the displacement of the receiving housing, so that the receiving housing and the counterpart housing are easily connected to each other with a small force.

As compared with a structure including a slide member for pivoting the lever to pull the housings mutually, in which the slide member is slid to connect the housings, the number of the components can be reduced. Thus, the construction can be simplified, thereby lowering its cost. Further, it can skip a complicated operation to slide the slide member.

In the connector according to the invention, the receiving housing can be very easily connected to the counterpart housing by fitting the case to the box. Further, accompanying the connecting operation, since the receiving housing is displaced in the direction to be pulled out from the opening of the bottom panel, a space between the end face panel of the case and the bottom panel of the box can be reduced as much as possible. Thus, it is possible to downsize an electronic device constituted of the box and the case.

Incidentally, the present invention is not limited to the above-described embodiments, and a modification, a variation or the like is allowed. In addition, material, shape, size, number, location or the like of each component in the above-described embodiments are arbitrary and not limited as long as they can attain the present invention.

While the present invention has been described with respect to the specific embodiments, it will be apparent to those skilled in the art that various changes and modifications may be made without departing from the spirit and scope of the invention defined in the following claims.

This application claims priority to Japanese Patent Application No. 2010-227478, filed on Oct. 7, 2010, which is incorporated herein by reference in its entirety.

The connector of the present invention has an effect in which the connector can be inserted and removed with the small force and the simple operation, without causing the increase in cost.

What is claimed is:

1. A connector comprising:

a receiving housing configured to be inserted and mounted in an opening of a panel;

a counterpart housing configured to be connected to the receiving housing; and a lever pivotally provided on the receiving housing and configured to pivot in accordance with a connecting operation of the counterpart housing to pull the counterpart housing, wherein the receiving housing is displaceable in a direction to be pushed out from the opening of the panel by the connecting operation, the lever includes one end to be engaged with the counterpart housing and the other end to be engaged with the panel, and the counterpart housing is pulled toward the receiving housing by the lever which pivots around a portion engaged with the panel as a fulcrum by the displacement of the receiving housing in accordance with the connecting operation.

2. The connector according to claim 1, wherein the counterpart housing is mounted on an end face panel forming an end face of a case, and the receiving housing is mounted on a bottom panel forming a bottom of a box in which the case is fitted, and the bottom is opposite to the end face panel.

* * * * *